US006789456B2

(12) United States Patent
DeRoos et al.

(10) Patent No.: US 6,789,456 B2
(45) Date of Patent: Sep. 14, 2004

(54) BRAKING SYSTEM

(75) Inventors: Bradley G. DeRoos, Fairmont, WV (US); Harvey N. Ebersole, Jr., Columbus, OH (US)

(73) Assignee: Battelle Memorial Institute, Columbus, OH (US)

( * ) Notice: Subject to any disclaimer, the term of this patent is extended or adjusted under 35 U.S.C. 154(b) by 59 days.

(21) Appl. No.: 10/376,492

(22) Filed: Feb. 28, 2003

(65) Prior Publication Data

US 2003/0154850 A1 Aug. 21, 2003

Related U.S. Application Data

(63) Continuation-in-part of application No. 09/942,409, filed on Aug. 29, 2001, now Pat. No. 6,578,464.

(51) Int. Cl.[7] ..... F41A 25/00

(52) U.S. Cl. ..... 89/42.01; 89/177; 42/1.06; 188/136; 188/151 R; 188/250 R

(58) Field of Search ..... 89/42.01, 177; 42/1.06; 188/136, 266.1, 381, 151 R, 2 R, 250 A; 166/117.6, 136, 137, 101, 196, 206

(56) References Cited

U.S. PATENT DOCUMENTS 3,866,724 A * 2/1975 Hollnagel ..... 188/129
3,951,238 A * 4/1976 Dent et al. ..... 188/381
4,498,517 A 2/1985 Mase
4,514,921 A 5/1985 Burkleca
4,656,921 A 4/1987 Zierler
4,709,758 A * 12/1987 Preston, Jr. ..... 166/120
4,842,234 A 6/1989 Koch
4,875,402 A 10/1989 Metz
4,924,751 A 5/1990 Metz et al.
4,972,760 A 11/1990 McDonnell
5,180,037 A 1/1993 Evans
5,215,170 A 6/1993 Rapa
5,309,817 A 5/1994 Sims
5,328,180 A * 7/1994 Benavides et al. ..... 279/2.16
5,353,681 A 10/1994 Sugg
5,617,664 A 4/1997 Troncoso
5,652,406 A 7/1997 Phan
5,794,703 A * 8/1998 Newman et al. ..... 166/381
6,062,350 A 5/2000 Spieldiener et al.
6,325,148 B1 * 12/2001 Trahan et al. ..... 166/297
6,347,505 B2 2/2002 Scheufeld
6,578,464 B2 6/2003 Ebersole, Jr. et al.

OTHER PUBLICATIONS

National Institute of Justice Final Report; Law Enforcement Robot Technology Assessment; 4.0 Validating & Prioritizing User Needs; Aug. 23, 2001; pp 1–14.

(List continued on next page.)

*Primary Examiner*—J. Woodrow Eldred
(74) *Attorney, Agent, or Firm*—William B. Richards

(57) ABSTRACT

A braking system is provided for mitigating the linear or rotational motion of an object having an axis, the linear or rotational motion being coaxial with the axis. In particular, the motion is the type which is the result of an impulse imposed over a short period of time, typically less than one second. The object whose linear or rotational motion is to be mitigated is disposed coaxially within a tube. The braking system includes at least one brake shoe positioned within an annular free space defined by the outer surface of the object and the inner surface of the tube. The at least one break shoe may be urged against the outer surface of the object or the inner surface of the tube to effect the mitigation.

15 Claims, 7 Drawing Sheets

OTHER PUBLICATIONS

Mini De Armer Disruptor Recoilless Stand Off; RE 9–9; RE 6.7–12; Richmond EEI Limited; Armtec Estate, North Lopham, Norfolk IP22 2LR, England.
Midi De Armer Disruptor Recoilless Stand Off; RE 12–12/28; Richmond EEI LTD.; Armtec Estate, North Lopham, Norfolk IP22 2LR, England.
Maxi De Armer Disruptor Recoilless Stand Off; RE 70 M3; Richmond EEI Limited; Armtec Estate, North Lopham, Norfolk, IP22 2LR, England.
Programs History Products Contacts News; Proparms Limited Products; Feb. 21, 2000; http://www.proparms.com/index.htm.

* cited by examiner

BRAKING SYSTEM

CROSS REFERENCE TO RELATED APPLICATION

This application claims priority as a continuation-in-part application of U.S. application Ser. No. 09/942,409, filed Aug. 29, 2001 is now U.S. Pat. No. 6,578,464, entitled "Recoil Mitigation Device", now U.S. Pat. No. 6,578,464, the disclosure of which is incorporated herein by reference to the extent not inconsistent herewith.

The invention was not made by an agency of the United States Government nor under contract with an agency of the United States Government.

FIELD OF THE INVENTION

This invention relates to brake assemblies and methods of braking objects having an axis moving in a lateral direction and to brake assemblies and methods of braking rotating objects. More generally, this invention relates to assemblies and methods of absorbing energy, particularly high-impulse energy.

BACKGROUND OF THE INVENTION

In any gun system, or more generally, projectile-firing device, conservation of momentum provides that the momentum carried by the projectile and the gases is equal to, but in the opposite direction of, the momentum imparted to the device. The momentum imparted to the device is, in turn, equal to the recoil force integrated over time, or the impulse. This is commonly referred to as the "kick" experienced when a gun is fired. While the total amount of momentum for a given projectile fired at a given velocity cannot be changed, it can be managed. The force-time profile can be changed from a very high, short-lived force to a longer, much lower amplitude force pulse.

Present recoil-mitigation devices utilize complex and expensive hydraulics, pneumatics, pistons, springs, friction, or some combination thereof. In addition, present devices are integral to the projectile-firing device and, therefore, not always easily or quickly adaptable to varying situations. Examples include U.S. Pat. Nos. 4,514,921 (coil spring compression), 4,656,921 (hydraulic fluid), 4,972,760 (adjustable recoil spring), 5,353,681 (recoil spring, friction, and pneumatics), and 5,617,664 (recoil spring).

In the particular case of some explosives disrupter devices for de-arming explosives devices, there may be no recoil mitigation. Disrupter devices are typically attached to a support frame mounted on the ground or mounted on a remote-controlled robot whereby the device can be triggered from a relatively safe distance to fire a projectile into an article suspected of containing a bomb or other explosive. Such devices are generally of a single-shot design and produce a significant impulse—oftentimes sufficient to propel the support frame/robot backwards, cause it to topple over, and/or sustain significant damage. Depending upon the situation, such devices may be called upon to fire a variety of projectiles at a variety of velocities from a variety of support frame/robots. This in turn creates a variety of recoil forces requiring, in turn, a variety of recoil mitigation solutions tailored to each support frame/robot. For example, the momentum imparted to the device from a column of water, often used to disarm soft-package bombs such as suspected briefcase bombs, may vary from close to 5 pounds-force-seconds at a low velocity to over 9 pounds-force-seconds at a high velocity (140 milliliter load at a velocity of 1000 feet per second) and even as high as 12 pounds-force-seconds. Metal slugs impart momentum in the range of 4 pounds-force-seconds to 6 pounds-force-seconds.

A general rule of thumb for a weapon without recoil mitigation fired by a human is that the momentum should not exceed 3 pounds-force-seconds. By comparison, the momentum carried by a 150 grain projectile fired from a 30-06 rifle at a velocity of 2810 feet per second is approximately 1.87 pounds-force-seconds. Thus, the momentum generated by an explosives disrupter can be relatively significant.

Therefore, there is a need for a recoil-mitigation device which overcomes these disadvantages.

In addition to recoil mitigation, passive devices and methods which mitigate the motion of high-impulse systems in general and which spread the total momentum of such impulses over a longer period of time, thus reducing the peak force experienced by the support apparatus, could prove quite useful.

BRIEF DESCRIPTION OF THE INVENTION

According to the present invention, a braking system is provided. The assembly includes at least one brake shoe, but preferably a pair of brake shoes, adapted to be interposed in a free space between a tube and an object whose motion is to be mitigated, the object being positioned coaxially within the tube. In the situation of mitigating linear motion, the brake shoes are laterally restrained relative to either the tube or the object, whereby when the object is subjected to an impulse, urging means, such as springs, create friction between the brake shoes and either the object or the tube respectively and the motion of the object is mitigated. Thus, it will be understood by those skilled in the art that the movement of the brake shoes may be first laterally restrained relative to the object and apply sliding friction to the inner surface of the tube. In the alternative, the brake shoes may be laterally restrained relative to the tube and apply sliding friction to the outer surface of the object. As it will be further understood by those skilled in the art, in the situation of mitigating rotational motion, the movement of the brake shoes may be first rotationally restrained relative to the object, or, in the alternative, rotationally restrained relative to the tube.

In a preferred embodiment of the present invention, the object is adapted to include a pair of flanges around the outer surface of the object. The flanges are in a facing, spaced-apart relationship such that a pair of substantially semi-cylindrical brake shoes is accommodated therebetween in a nesting position preventing lateral movement of the brake shoes relative to the object while allowing the brake shoes to move radially relative to the object. Coil or other suitable springs are provided between the edges of each brake shoe wherein the brake shoes are urged in a direction toward the inner surface of the tube. When the object-brake shoe-coil spring combination is positioned coaxially within an elongated tube and the object subjected to an impulse, the springs urge the brake shoes against the inner surface of the tube creating friction and thus the linear motion of the object is mitigated. A variety of springs and/or spacers to foreshorten the springs provides the flexibility needed to match the friction to a variety of mitigation needs.

Accordingly, the principle object of the present invention is to provide a friction brake motion mitigation apparatus that is readily adapted to a variety of supports, objects, and impulses for mitigating the motion of objects. Further objects, advantages, and novel aspects of the present invention will become apparent from a consideration of the drawings and subsequent detailed description.

BRIEF DESCRIPTION OF THE DRAWINGS

The subsequent detailed description particularly refers to the accompanying figures in which.

DETAILED DESCRIPTION OF THE INVENTION AND BEST MODE

Figure 1:
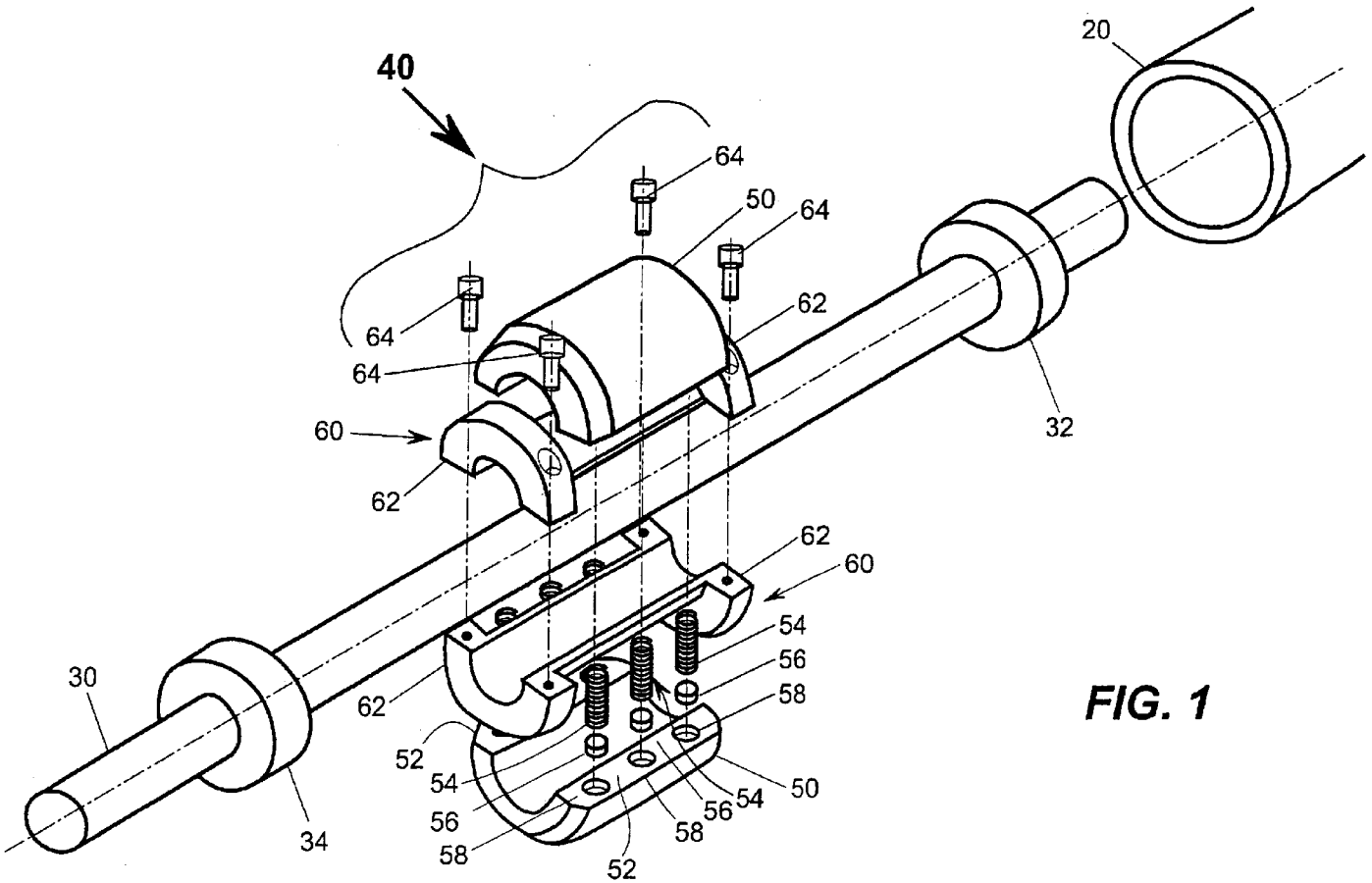
FIG. 1 is an exploded view of the braking system adapted to a cylindrical object according to the teachings of the present invention.
Figure 2:
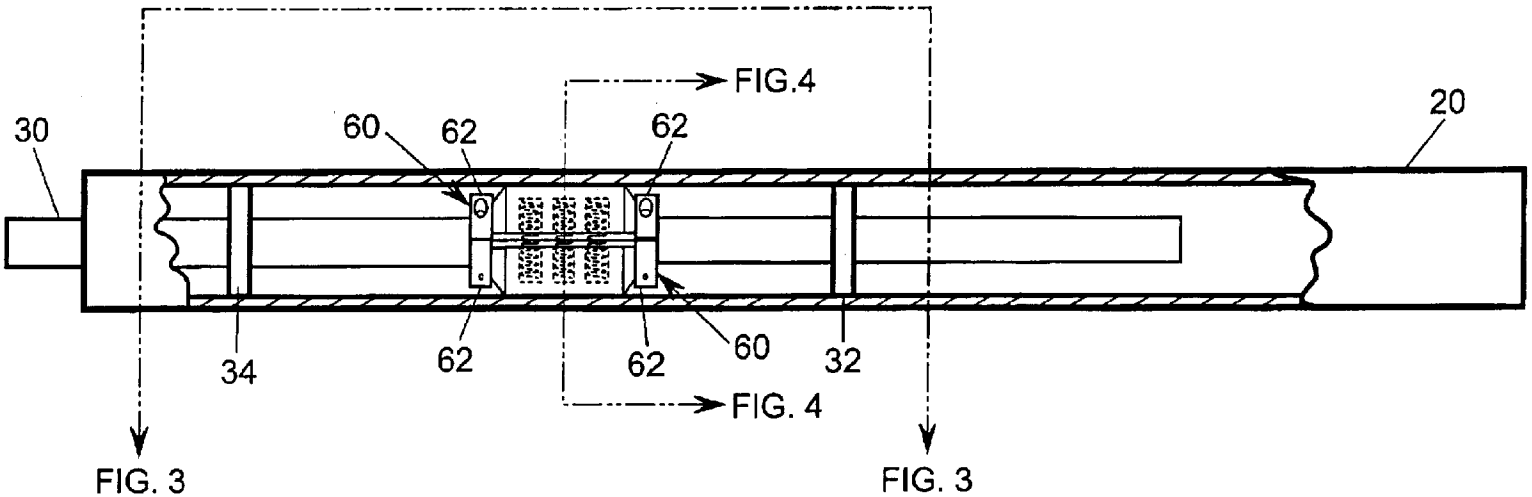
FIG. 2 is a cutaway elevation view of the braking system-object combination shown in FIG. 1.

An exploded assembly view of the brake assembly 40 adapted to linear motion of a cylindrical object 30 is shown in FIG. 1. Cylindrical object 30 represents any object whose motion, particularly impulse-induced motion, one desires to mitigate. The brake assembly 40 is restrained laterally relative to the to the object 30 by, for example, clamp 60 secured to the object 30 and the combination of the object 30 and the brake assembly 40 is frictionally positioned within a tube 20. Typically, the tube 20 is attached to a support frame (not shown). As a reaction to, for example, an impulse, the brake assembly 40-object 30 combination moves linearly relative to the tube 20 and friction created between the brake shoes 50, urged by urging means 54 against the tube, and the tube 20 acts to mitigate the motion of the object 30. Thus, the energy of the impulse is partially converted to heat, is spread out over a longer period of time, and its maximum force is reduced. (Shown in FIG. 6.)

Figure 9:
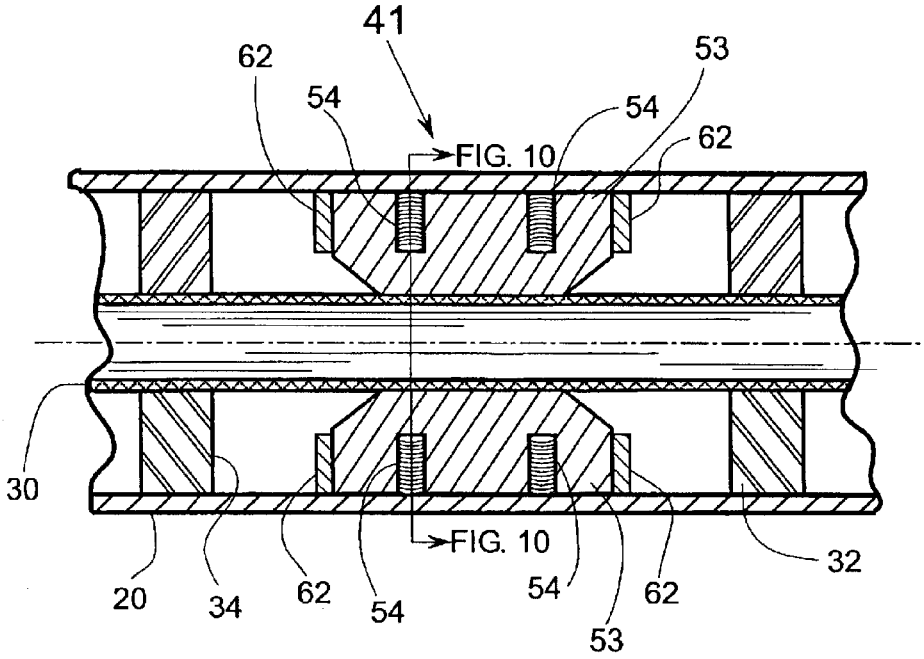
FIG. 9 is a modification of FIG. 3 showing an embodiment with the pair of brake shoes restrained from lateral movement relative to the tube.

It is understood, however, that the brake assembly 40 need not be restrained laterally relative to the object 30 and the combination move relative to the guide tube 20. As shown in FIG. 9, it will be recognized by those skilled in the art, that it is within the scope and spirit of the invention that a brake assembly 41, comprising brake shoes 53, may be restrained laterally relative to the tube 20 by, for example, shoulders or tabs 62 secured to the tube 20 and the object 30 move linearly relative to the brake assembly 41-tube 20 combination. In such an embodiment, urging means 54 urge the brake shoes 53 against the object 30 to create the friction to mitigate the motion of the object 30 relative to the brake assembly 41-tube 20 combination.

Figure 3:
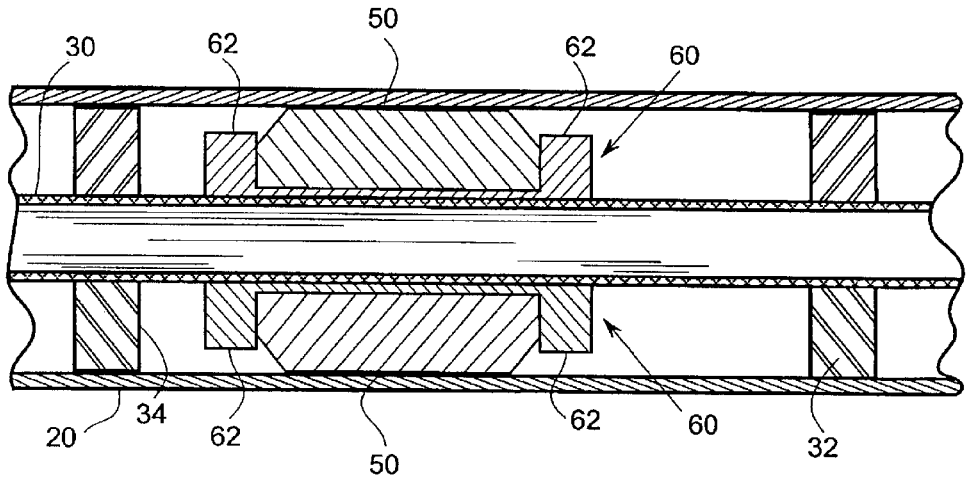
FIG. 3 is a lateral sectional view taken along the line 3—3 of FIG. 2.

Referring back to FIG. 1, the brake assembly 40, then, provides a friction, or stopping force with the tube 20 which mitigates the motion of the object 30. The brake assembly 40 includes a clamp 60 attachable to the object 30. As shown in FIGS. 1 and 3, the clamp 60 is formed to include a first and a second flange 62 at either end. At least one, or preferably a pair of brake shoes 50 are sized to nest between flanges 62 whereby the lateral movement of the brake shoes 50 relative to the object 30 is restricted.

In a preferred embodiment, as shown in FIG. 1, clamp 60 comprises two semi-cylindrical elements which are secured to the object 30 using screws 64 or other suitable means. Alternatively, the clamp 60 may be of a single-piece construction and slideable over the object 30 prior to being secured. Also, the clamp 60 may be secured with any suitable set screws, adhesive, or welded to the object 30. The flanges 62 of the clamp 60 thus restrict the lateral movement of the brake shoes 50 which allows the brake assembly 40-object 30 combination to frictionally slide together in the tube 20. Flanges 62 are also formed to allow each brake shoe 50 to move outwardly relative to the object 30. It will be recognized by those skilled in the art, that it is within the spirit and scope of the invention that the lateral movement of the brake shoes 50 relative to the object 30 may be restricted by suitable flanges or detents alone attached to, or formed with, the object 30.

Continuing with a preferred embodiment, as shown in FIG. 1, each brake shoe 50 is substantially C-shaped and substantially semi-cylindroid and formed to include a pair of lands 52 running parallel to a long axis of each brake shoe 50 along each lateral edge. The shape of each brake shoe 50 conforms to the inner surface shape of the tube 20. This conformity provides frictional surface-to-surface contact between each brake shoe 50 and the inner surface of the tube 20. Thus, it will be recognized by those skilled in the art, that it is within the spirit and scope of the invention that the tube 20 may have a rectangular or any suitable cross-section. Each brake shoe 50, therefore, would be shaped to conform to such tube 20.

Figure 8:
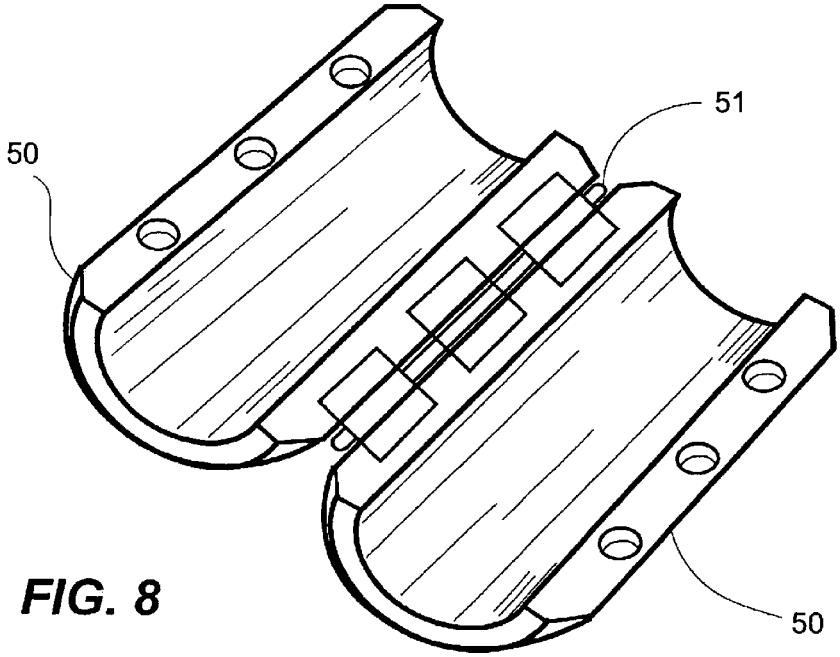
FIG. 8 is a perspective view of a clamshell design of a pair of the brake shoes.

In yet another embodiment, the brake shoes 50 are rotatably connected to each other with a hinge 51 or other similar means as shown in FIG. 8. In this embodiment, one or more springs 54, with or without spacers 58, may be employed on the opposite side of the brake shoes 50.

The actual friction, or stopping force is related to the normal force between the brake shoes 50 and the inner surface of the tube 20 by the following equation:

$$F_{stopping}=F_{normal}*\mu$$

where $\mu$ is the coefficient of friction between two materials. Book values of $\mu$ are available in many engineering texts or handbooks. For example, the ASM Handbook, Volume 18, *Friction, Lubrication, and Wear Technology*, ASM International (formerly American Society for Metals) (1992) reports values for a flat steel surface moving on another flat steel surface of 0.31 static and 0.23 kinetic. As will be appreciated by those skilled in the art, a higher force is required to overcome static (before the surfaces are in sliding motion relative to one another) friction than kinetic (once the surfaces are in sliding motion relative to one another) friction. From the same reference, for aluminum on steel the values are 0.25 static and 0.23 kinetic. Factors such as the basic material compositions as well as the finish of the surfaces affect the coefficients of friction.

Figure 4:
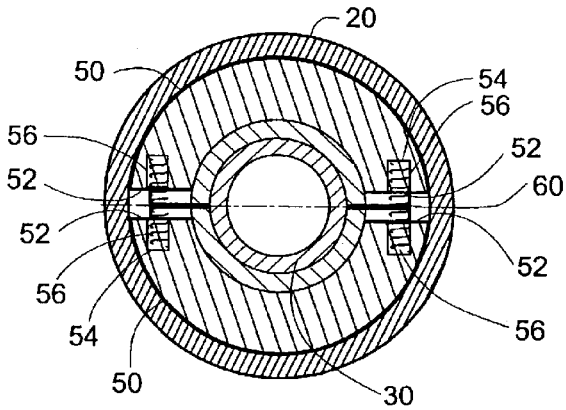
FIG. 4 is a cross-sectional view taken along the line 4—4 of FIG. 2.

In the preferred embodiment, pairs of coil springs 54 or other suitable urging means are positioned between opposing lands 52 of opposing brake shoes 50 to provide the force needed ($F_{normal}$) to frictionally contact each brake shoe 50 with the inner surface of the tube 20. As best seen in FIGS. 1 and 4, the end of each coil spring 54 is seated within a cavity 56 formed in the lands 52 of each brake shoe 50. Also, seen in FIG. 1, selected spacers 58 may be inserted into cavity 56. The spacers 58 thus provide that the coil springs 54 are further compressed and urge the brake shoes 50 against the inner surface of the tube 20 with greater force. As will be understood by those skilled in the art, the normal force ($F_{normal}$) exerted by various spring 54 and spacer 58 can be varied widely. Thus, the combination of coil springs 54 in both number of pairs and strength, and spacers in dimension, allows numerous combinations to provide the friction, or stopping force ($F_{normal}$) to match the intended application.

Coil springs 54 of three different strengths, manufactured by Lee Spring Company, Brooklyn, N.Y. were used. These included medium, medium heavy, and extra heavy. All were one-inch in length. Spacers 58 of three different dimensions were used. These included 0.1, 0.2, and 0.3-inch. Other suitable springs 54 and spacers 58 may be used as the circumstances warrant.

Figure 6:
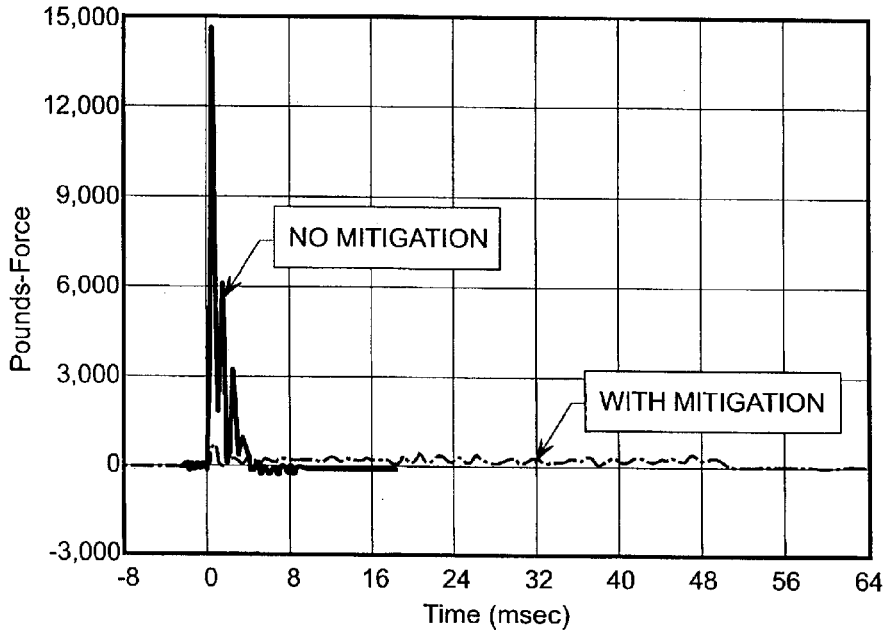
FIG. 6 is a graphical representation of the impulse curve for a non-mitigated motion versus a mitigated motion.

Selection of materials of construction of both the tube 20 and the brake shoes 50 also affects the friction, or stopping force. Travel distance and pounds-force may be important. As shown in FIG. 6, the combination of steel brake shoes 50 with an aluminum tube 20 gives good results. FIG. 6 shows the force curve measured with no mitigation compared with the force curve measured with a mitigation combination of an aluminum tube 20, steel brake shoes 50, three pairs of springs 54 (extra heavy), and three pairs of 0.1-inch spacers 58. (The use of an aluminum tube 20 also aids in managing total added weight. The curve shown in FIG. 6, for the "WITH MITIGATION" example was produced with a spring pair 54-spacer 58 combination which provided a calculated normal force of 330 pounds-force. As shown in FIG. 6, the maximum static peak, a very short narrow pulse, was reduced from 14,638 pounds-force to 794 pounds-force. The approximate period of force pulse, the time period over which the recoil energy is dissipated, was increased from 5.1 milliseconds to 52 milliseconds. As stated above, the total impulse can be managed but not changed. As confirmation, the impulse for the test with no recoil mitigation was calculated to be approximately 13 pounds-force-seconds while the impulse for a test with recoil mitigation was calculated to be just over 13 pounds-force-seconds.

Alternatively, the outer surface of the brake shoes 50 and/or the inner surface of the tube 20 may comprise any suitable friction material such as those used in vehicle braking systems. Thus, for example, a friction material adapted for contact with the inner surface of the tube 20 may be bonded or otherwise adhered to the outer surface of the brake shoes 50. It will be appreciated by those skilled in the art, that it is within the spirit and scope of the invention that there are numerous combinations of materials that may be utilized to provide the desired recoil mitigation.

Figure 5:
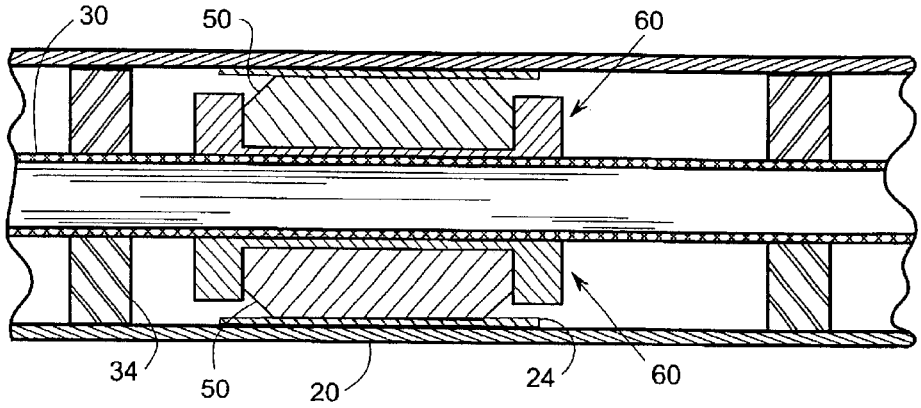
FIG. 5 is modification of FIG. 3 showing a low-friction coating on a portion of the inner surface of the tube.

FIG. 6 shows that an initial static peak may occur as static friction is being overcome. As discussed above, the coefficient of static friction is larger than that of kinetic friction. Thus, a larger force peak is generated as this greater frictional resistance is overcome. This larger force peak may be reduced by modifying the inner surface of the tube 20 as shown in FIG. 5. This may be accomplished with a coating of low-friction material 24, such as polyethylene or other suitable material, on the inner surface of the tube 20 where the brake assembly 40 is initially positioned. When the impulse is applied, the lower force necessary to overcome the static friction between the brake shoe 50 and the inner surface of the tube 20 with a low-friction material 24 reduces the initial static peak. When the brake assembly 40 moves beyond the low-friction material 24 and begins sliding over the other material of the inner surface of the tube 20, the brake assembly 40-object 30 combination is already moving and little or no additional static peak is produced. Alternatively, the outer surface of the object 30 may be similarly modified if the embodiment shown in FIG. 9 is utilized.

As the object 30 is necessarily of somewhat narrower outside diameter than the inside diameter of the tube 20, means may be provided to prevent the object 30 from becoming canted in the tube 20. FIG. 1 shows an aft washer insert 32 and a fore washer insert 34. While these may be of any suitable material, polypropylene is satisfactory. It will also be appreciated by those skilled in the art that if the brake assembly 40 is positioned on the object 30 in a generally fore position, the necessity of the fore washer insert 34 may be eliminated.

In operation, the clamp 60 is secured to the object 30 using screws 64. Fore washer insert 34 and aft washer insert 32 are positioned in a fore and aft position respectively on the object 30. A suitable combination of springs 54 and spacers 58 are selected for the application. The spacers 58 (if required) and the springs 54 are placed within the appropriate cavities 56 of one brake shoe 50. The pair of brake shoes 50 is then positioned within the flanges 62 of the clamp 60. The entire combination is then positioned within the tube 20. Following an impulse, as the brake 40-object 30 combination is forced to move linearly, the friction created by the brake shoes 50 and the inner surface of the tube 20 mitigates the motion.

Figure 7:
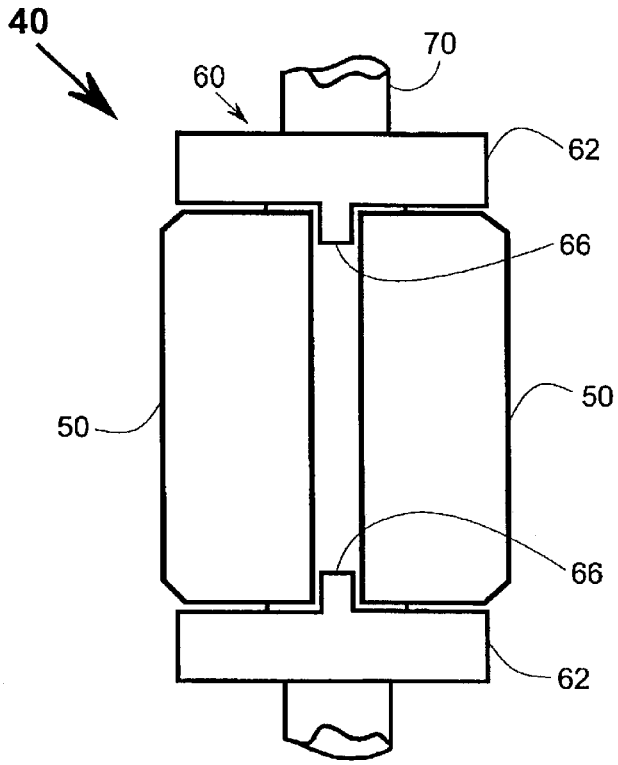
FIG. 7 is an elevation view showing a clamp formed to include shoulders to limit the rotational movement of the brake shoes relative to the object.

FIG. 7 shows a further embodiment which includes a clamp 60 formed to include shoulders 66. Thus, a rotational object 70 may be braked with the braking device of the present invention. The shoulders 66 prevent the brake shoes 50 from rotating about the axis of rotation relative to the object 30 and the friction created between the brake shoes 50 and the inner surface of the tube 20 mitigates the motion of the rotational object 70.

Figure 10:
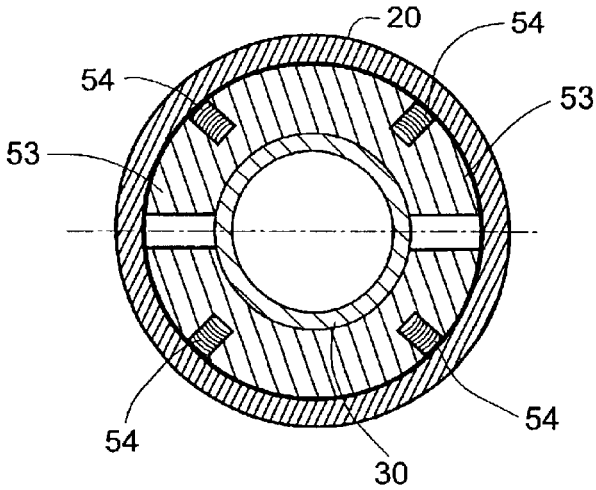
FIG. 10 is a cross-sectional view taken along the line 10—10 of FIG. 9 and is a modification of FIG. 4 showing the embodiment of FIG. 9 with the pair of brake shoes being urged in an inward direction.

FIG. 10 more clearly illustrates how the urging means 54 may be installed. Thus, the brakes shoes 53 are urged against the outer surface of the object 30 creating the frictional force needed to mitigate the rotational movement of the object 30.

Figure 11:
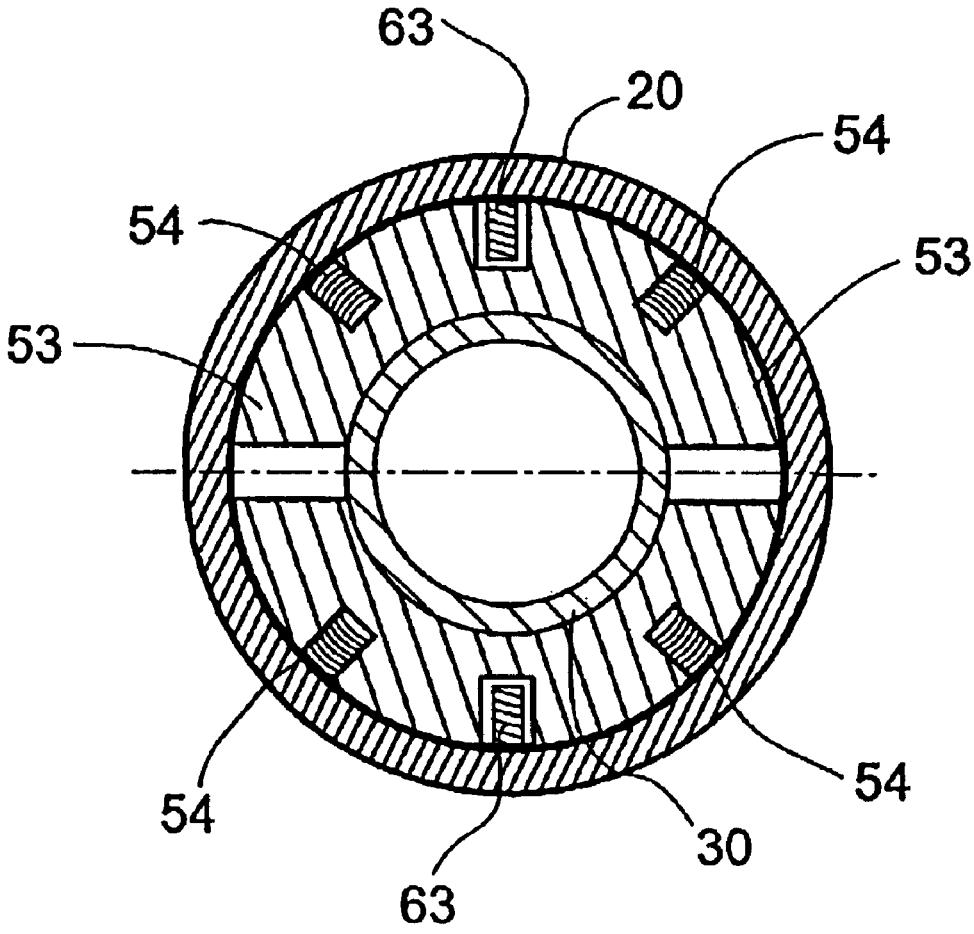
FIG. 11 is a modification of FIG. 7 showing an embodiment with the pair of brake shoes restrained from rotational motion relative to the tube.

FIG. 11 shows a further embodiment which includes flanges 63 secured to, or formed upon, tube 20. The flanges 63 prevent the brake shoes 53 from rotating about the axis of rotation and the friction created between the brake shoes 53 and the outer surface of the rotating object 30 effects the mitigation of the rotation of the rotating object 30.

Although the invention has been described in detail with reference to certain preferred embodiments, variations and modifications exist within the scope and spirit of the invention as described and defined in the following claims.

We claim:

1. A braking system for mitigating the linear motion of an object, the object having an axis, the linear motion being coaxial with the axis, the braking system comprising:

a tube, the tube positioned coaxially around the object;

at least one brake shoe, the at least one brake shoe adapted to be positioned in a free space defined by the outer surface of the object and the inner surface of the tube;

a coating of low-friction material adhered to a portion of the inner surface of the tube and interposed between the inner surface of the tube and the at least one brake shoe;

means attached to the object for limiting the lateral movement of the at least one brake shoe relative to the object while permitting the radial movement of the at least one brake shoe relative to the object; and means for urging the at least one brake shoe in an outward radial direction, wherein the at least one brake shoe is put in frictional contact with the low-friction material, whereby, when the object is moved in a linear direction, the braking system mitigates the linear motion of the object.

2. The braking system of claim 1, wherein the limiting means is adapted to enable the object to freely rotate about its major axis relative to the at least one brake shoe.

3. The braking system of claim 1, wherein the number of shoes is two.

4. The braking system of claim 3, wherein the two shoes are connected together with hinges in a clamshell-like manner.

5. The braking system of claim 3, wherein the urging means comprises two or more springs, the springs disposed between the two shoes.

6. The braking system of claim 3, wherein the two shoes are connected in a clamshell configuration.

7. The braking system of claim 1, wherein the low-friction material is polyethylene.

8. A braking system for mitigating the linear motion of an object, the object having an axis, the linear motion being coaxial with the axis, the braking system comprising:

a tube, the tube positioned coaxially around the object;

at least one brake shoe, the at least one brake shoe adapted to be positioned in a free space defined by the outer surface of the object and the inner surface of the tube;

a coating of low-friction material adhered to a portion of the outer surface of the object and interposed between the outer surface of the object and the at least one brake shoe;

means attached to the tube for limiting the lateral movement of the at least one brake shoe relative to the tube while permitting the radial movement of the at least one brake shoe relative to the tube; and means for urging the at least one brake shoe in an inward radial direction, wherein the at least one brake shoe is put in frictional contact with the low-friction material, whereby, when the object is moved in a linear direction, the braking system mitigates the linear motion of the object and a force-time profile of the motion is substantially constant.

9. The braking system of claim 8, wherein the number of shoes is two.

10. The braking system of claim 9, wherein the two shoes are connected in a clamshell configuration.

11. The braking system of claim 9, wherein the urging means comprises two or more springs, the springs disposed between the inner surface of the tube and each brake shoe.

12. The braking system of claim 8, wherein the low-friction material is polyethylene.

13. A method of mitigating the linear motion of an object, the object having an axis, the method comprising the steps of:

(a) positioning the object coaxially within an elongated tube;

(b) positioning at least one brake shoe in a free space defined by the outer surface of the object and the inner surface of the tube, a portion of the inner surface of the tube adjacent to the at least one brake shoe having a coating of low-friction material adhered thereto;

(c) providing means attached to the object for limiting the lateral movement of the at least one brake shoe relative to the object while permitting the radial movement of the at least one brake shoe relative to the object; and (d) urging the at least one brake shoe in an outward radial direction, wherein the at least one brake shoe is put in frictional contact with the low-friction material, whereby, when the object is moved in a linear direction, the linear motion of the object is mitigated.

14. A method of mitigating the linear motion of an object, the object having an axis, the method comprising the steps of:

(a) positioning the object coaxially within an elongated tube;

(b) positioning at least one brake shoe in a free space defined by the outer surface of the object and the inner surface of the tube, a portion of the outer surface of the object adjacent to the at least one brake shoe having a coating of low-friction material adhered thereto;

(c) providing means attached to the tube for limiting the lateral movement of the at least one brake shoe relative to the tube while permitting the radial movement of the at least one brake shoe relative to the tube; and (d) urging the at least one brake shoe in an inward radial direction, wherein the at least one brake shoe is put in frictional contact with the low-friction material, whereby, when the object is moved in a linear direction, the linear motion of the object is mitigated and a force-time profile of the motion is substantially constant.

15. A brake assembly for mitigating the linear motion of a first object relative to a second object, each object having an axis and the second object positioned coaxially around the first object, the linear motion being coaxial with the axes, the brake assembly comprising:

at least one brake shoe pair, the at least one brake shoe pair adapted to frictionally contact the inner surface of the second object and adapted to be positioned in a free space defined by the outer surface of the first object and the inner surface of the second object;

a coating of low-friction material adhered to a portion of the inner surface of the second object and interposed between the inner surface of the second object and the at least one brake shoe pair;

means attached to the first object for limiting the lateral movement of the at least one brake shoe pair relative to the first object while permitting the radial movement of the at least one brake shoe pair relative to the first object; and means for urging the at least one brake shoe pair in an outward radial direction toward the low-friction material, wherein the at least one brake shoe pair is put in frictional contact with the low-friction material, whereby, when the first object and the second object are moved in a linear direction relative to each other, the brake assembly mitigates the linear motion of the first object relative to the second object.

* * * * *